United States Patent [19]

Kirkpatrick et al.

[11] Patent Number: 4,535,851

[45] Date of Patent: Aug. 20, 1985

[54] FLUID FLOW MEASUREMENT SYSTEM

[75] Inventors: Lloyd V. Kirkpatrick, Beaumont; John R. McGee, Simonton, both of Tex.

[73] Assignee: Kirkpatrick-McGee, Inc., Houston, Tex.

[21] Appl. No.: 473,645

[22] Filed: Mar. 9, 1983

[51] Int. Cl.[3] ..... E21B 21/08; E21B 44/00

[52] U.S. Cl. ..... 175/38; 175/24; 175/48; 175/218

[58] Field of Search ..... 175/7, 24, 38, 40, 48, 175/207, 217, 218; 166/355

[56] References Cited

U.S. PATENT DOCUMENTS

| | | | |
|---|---|---|---|
| 3,443,643 | 5/1969 | Jones | 175/218 |
| 3,646,808 | 3/1972 | Leonard | 175/40 |
| 3,811,322 | 5/1974 | Swenson | 175/48 |
| 4,176,722 | 12/1979 | Wetmore et al. | 175/7 |
| 4,432,064 | 2/1984 | Barker et al. | 175/40 |

FOREIGN PATENT DOCUMENTS

| | | | |
|---|---|---|---|
| 0950905 | 8/1982 | U.S.S.R. | 175/24 |
| 0969885 | 10/1982 | U.S.S.R. | 175/24 |

*Primary Examiner*—Stephen J. Novosad
*Assistant Examiner*—William P. Neuder
*Attorney, Agent, or Firm*—Llewellyn A. Proctor

[57] ABSTRACT

A system, or apparatus combination, and apparatus components, for the measurement of fluid flow. Such system, or apparatus can be used, e.g., for measuring the amount or flow of drilling fluid, or mud, introduced into a well bore, the amount or flow of mud returned from the well bore, and differences in flow rate and density between the mud introduced into the well bore and the mud returned from the well bore. The system measures or calculates, inter alia, flow rates, viscosity, temperature, density and gas content and compensates for variations; and in marine installations the system additionally measures vessel motion and compensates for wave and tide motions. The system includes on the mud input side one or more measurement primaries for the measurement or calculation, inter alia, of flow rates, viscosity, temperature and density, and on the mud return side a gas monitor is provided for the measurement and compensation of gas contained within a multiphase mud slurry returned from down-hole, and one or more measurement primaries for the measurement or calculation, inter alia, of flow rates, viscosity, temperature and density. For semi-submersible or floating marine installations vessel motion is measured. The system includes one or more computers. For example, the system can include a mud in-flow computer which receives and calculates inputs from the one or more mud input measurement primaries, a return mud flow computer which receives and calculates inputs from the one or more mud return measurement primaries and the gas content monitor and central computer with which the mud in-flow computer and return flow computer are in constant two way data communication. In marine installations, motion measurements are input directly to the central computer.

16 Claims, 14 Drawing Figures

FLUID FLOW MEASUREMENT SYSTEM

BACKGROUND OF THE INVENTION

1. Field of the Invention

This invention relates generally to apparatus useful for measuring fluid flow. In particular, it relates to improvements in apparatus for monitoring well down-hole conditions, particularly to a monitoring device for measuring the flow of mud, and other drilling-fluid parameters relating to flow in real time in the drilling of oil and gas wells.

2. Problems and Description of the Prior Art

Rotary drilling, as practiced in oil and gas exploration, requires the formation of a hole, or well bore extending downwardly from the earth's surface to an oil or gas entrained stratum. Formation of the well bore requires generally a casing extending from the earth's surface downwardly to a depth necessary to protect surface formations and to avoid fluid loss. The casing and well bore are extended downwardly by continued cutting into the earth's surface with a rotating bit attached to the end of a drill pipe string to which joints of pipe are sequentially attached as the well bore is extended from the surface downwardly. In the drilling operation, a drilling fluid, or mud, constituted generally of a mixture of weighting materials, clays, chemicals, and water or oil, is removed from a mud pit and pumped down the drill string into the sealed well bore to exit through jets in the drill bit at the bottom of the hole, the fluid or mud being recycled, ascending to the surface via the annular space between the exterior wall of the drill string and the wall of the hole, or well bore. At the surface, the fluid received from the casing flows to conditioning devices for cuttings removal, and it is then returned to the mud pit for treatment and storage for further use.

The drilling fluid serves several essential functions, the most important of which are to seal off permeable formations to prevent loss of drilling fluid as the well is drilled through different subterranean formations, lubricate the drill bit and drill string, support and protect the bore walls and reduce to a minimum harm to formations penetrated, provide a hydrostatic head to restrain the flow of high pressure oil, gas or water from subterranean formations into the well bore, remove cuttings from the well and, in the event of a shutdown in the drilling operation, to hold the cuttings, sand and other residual materials in suspension within the static column of drilling fluid. Substantial quantities of clays and other colloidal materials are added by the mud engineer to assist in imparting the required density, viscosity and gel strength to the drilling fluid as required for the entrainment and suspension of the cuttings. This is necessary because down-hole conditions creates these, and other physical and chemical changes in the drilling fluid. Gas, water and oil also become components of the drilling fluid, which is or becomes a multiple phase slurry constituted of liquids, solids and gases. The rheological, or flow properties of the drilling fluid during use thus invariably change due to additions made to the drilling fluid by the mud engineer, and because of various conditions which produce undesired changes in the thixotropic properties of a drilling fluid, this making it mandatory to constantly treat the drilling fluid to maintain the desired density and thixotropy. It is imperative that the drilling fluid be sufficiently fluid that it can be pumped, and sufficient hydrostatic pressure must be maintained by the column of drilling fluid to prevent escape of gas or oil from the surrounding strata as the depth of the well bore is extended into the earth.

It is further and particularly imperative during drilling operations that the operator monitor down-hole conditions. The operator, in particular, must have information relating to changes in the circulation, or flow of the drilling mud, and he must have it as soon as possible, to make intelligent operational and procedural decisions relating to the drilling operation. Of vital importance, the operator must know the amount of fluid that is introduced into the well bore, and the amount of fluid that is returned to the surface from the well bore. Circulation changes do occur due, e.g. to gas pockets, structure crumbling, and the like; and these are often unsafe conditions. A lesser flow of fluid from the well bore than the input of fluid into the well bore may thus indicate "loss-of-circulation", a phenomenon wherein drilling fluid is lost into a formation cavity. Under such circumstances the well can be lost due to insurmountable economic costs. Conversely, a higher flow of fluid from the well bore than the flow of fluid into the well bore may indicate that fluids are being transported from the surrounding strata into the well bore. This effect could be caused by anything from salt water to high pressure gas. This latter condition can not only produce an economic disaster through complete loss of the well, equipment and drilling rig itself, but can also result in serious injuries and the loss of human lives.

Whereas attempts have been made over many years to measure the gain or loss of drilling fluid circulation in real time, such attempts have never been very successful. Thus, flow meters have been used to measure mud input, and output, one value being subtracted from the other to determine net mud flow. A principal difficulty with flow meters has been their inability to accurately measure flow rate ranges on the order of 150 or 160 to 1, as is required. Moreover, albeit the drilling fluid input to the well may be relatively homogenous, the return flow of drilling fluid is all but homogenous. With regard to fluid input, or fluid output, the wide range of changes in the density of the fluid, from about 0.75 to about 2.65 times the specific gravity of water, and changes in viscosity, from about 1 to about 100 centipoises, caused by the necessary addition of weighting materials, chemicals and clays to tailor the density and viscosity of the fluid to changing down-hole conditions adds to the complexity of the problem. Measurement of flow, and the rate changes in flow of mud is further compounded in that there are flow fluctuations, and pulsating flow since the mud is necessarily pumped into and thus out of the well bore. In addition there are changes in fluid vapor pressure, critical pressure, temperature, and the proportion of gas, vapor and solids present in the mud. The return flow of mud is far more difficult to measure than the input flow because in addition to these problems, there is little hydrostatic pressure, head, or net energy, to perform flow measurement. Gases and solids are admixed with liquids, and the pipe returning the multiphase slurry is not necessarily filled. Further, the mud may have a water base or oil base, and this is subject to change, which in itself creates many problems which adversely affect the accuracy, or operability of flow meters. For example, the presence of even a small amount of oil in mud can relatively quickly decommission a magnetic flow meter by laying down a film on the electrodes, this resulting in a drastic loss of accuracy in measuring the rate of flow of the mud.

Another very different, and very difficult set of problems is introduced on semi-submersible or floating drilling rigs by the tide and wave motions of the sea. However, the problem that overwhelms all other motion problems in ocean drilling relates to the erratic flow and changes in the rate of flow of the return mud caused by vessel heave. This is because the mud of non-homogenous consistency within the riser slip joint located adjacent the bottom of the vessel is suddenly deaccelerated as the vessel rises, and then suddenly accelerated in various directions different from the net direction of flow as the vessel carrying the rig descends; this occurring while the vessel is rolling, pitching and yawing. The system behaves much in the manner as a large positive displacement pump. The magnitude of the problem in measuring the flow in such system of multiphase muds can be appreciated when it is realized that seven to nine foot waves are created, as in the Gulf of Mexico with very little wind, and that fifty to sixty foot waves are common in the North Sea, with even higher wave action during stormy weather. The result is that when the vessel is descending the mud is pumped very rapidly as a great slug of mud through the chamber formed by the riser slip joint. Conversely, at a moment when the vessel is rising the flow is drastically slowed, or may be completely interrupted. Thus, for several moments there is a great slug flow of mud passing through the chamber, and shortly thereafter there is no flow at all. A device or method for the adequate measurement of pulsating flows produced in this manner has been needed since the introduction of floating drill platforms, and while many have recognized the problem, satisfactory solutions have not been forthcoming.

It is nonetheless a primary objective of the present invention to obviate these and other prior art problems.

A particular objective of the present invention is to provide apparatus, apparatus combinations, and process, for measuring to a high degree of reliability, accuracy, and precision the rate of flow, differential flow rates and other parameters of a fluid, notably a drilling mud, used during such oil and gas well drilling operations.

Moreover, it is an object to provide apparatus, apparatus combination, and process for measuring or calculating the viscosity, density, temperature, and the rate of flow of a fluid, notably the drilling mud passing downwardly through the drill pipe string, the viscosity, density, temperature and rate of flow of the return drilling mud ascending to the earth's surface from within the well bore, any differences in the density and flow rate between the mud introduced into the well bore and the mud returning from the well bore, and a running total of these differences.

Another object is to provide apparatus, and an apparatus combination of the character described which is fully compensated for variations in pressures, temperature, density, viscosity, gas content and atmospheric conditions; which apparatus, or apparatus combination, is self cleaning, self calibrating and self checking for abberations or abnormalities, and which can automatically prevent flashing and cavitation conditions within the primaries which might be detrimental or harmful to measurements.

A further objective is to provide apparatus, and apparatus combinations as characterized, which measures water base and hydrocarbon base fluids with equal accuracy as well as mixtures of water, hydrocarbons, liquids, gases and solids, and includes as well added compensation for use on off-shore semi and floating vessels.

A yet further, and more specific object is to provide apparatus, and apparatus combinations as characterized, for off-shore floating or semi-floating vessels which measures vessel motion and compensates for wave and tide motions.

THE INVENTION

These objectives and others are achieved in accordance with the present invention constituting an apparatus combination, or system and major apparatus components, embodying generally the following:

an input mud measurement primary device, or a plurality of input mud measurement primary devices, suitably arranged in parallel, through which an input mud is passed and then fed via a mud pump, or pumps, to a well bore which is provided with means for measuring or calculating, inter alia, temperature, density, viscosity, and rate of flow of the mud via differential pressure sensor means, or sensors, located on opposite sides of a variable orifice, a return mud gas monitor through which multiphase gas-containing mud returned from the well bore is passed and measurement made of the gas volume of the mud, and correction made therefor for more accurate determination of the mud component of the multiphase gas-containing mud returned from the well bore, and a return mud measurement primary device, or a plurality of return mud measurement primary devices, suitably arranged in parallel, through which the return mud is passed, the return mud measurement primary device being provided with means for measuring or calculating, inter alia, temperature, density, viscosity, and rate of flow of the mud via differential pressure sensor means, or sensors, located on opposite sides of a variable orifice.

The system includes, in marine installations, a means located near the riser for measuring vessel motion. A baffled surge chamber, or return mud accumulator device receives the return mud from the riser. A mud, or liquid level is contained within the surge chamber. The baffled surge chamber smoothes out and accumulates excess flow of the mud, thus reducing the slug flow effects produced by vessel motion. Some degassification of the mud occurs in the surge chamber.

The system includes one or more computers. Suitably, the system includes a mud in-flow computer, a mud return flow computer, and a central computer. The mud in-flow computer calculates the fluid density and the compensated flow of the input mud to the well, and, inter alia, controls the position of the variable orifice of the input mud measurement primary device, or devices, a mud return flow computer calculates the fluid density (two conditions) and the flow of return mud from down hole, calculates the percent of gas and vapor contained in the mud, and, inter alia, controls the position of the variable orifice in the mud return measurement primary device, or mud return measurement primary devices, and both the mud in-flow computer and mud return flow computer are in continuous data communication with the central computer, and the central computer calculates, inter alia, the compensations required by vessel motions, the input mud to the well bore, the output mud from the well bore, gains or losses in mud flow rate, total mud accumulated gains and losses and mud density, and carries on a continuous two way communication of these data to an operative or control panel and a terminal from which commands are received.

The apparatus combination or system, apparatus components, and the principle of operation will be more fully understood by reference to the following detailed description of a preferred embodiment, and to the attached drawing to which reference is made as the description unfolds. Similar numbers are used to represent similar parts or components in the drawing, and subscripts are used with numbers to represent component parts of an assembly.

In the drawing:

FIG. 1 schematically depicts two identical input mud measurement primary devices for measuring density, temperature and mud flow rate arranged in parallel for withdrawal of mud from a supply source, the input mud measurement primary devices being mounted, respectively, in the suction line of a pair of mud pumps which pump the mud to the bottom of the well bore.

FIG. 2 schematically depicts a vessel heave measuring device, a surge chamber for receipt of the return mud, a gas monitor for measurement of the entrained gas content of the return mud, a return mud measurement primary device for measuring density, temperature and mud flow rate, and downstream facilities for further processing of the mud.

Figure 6D:
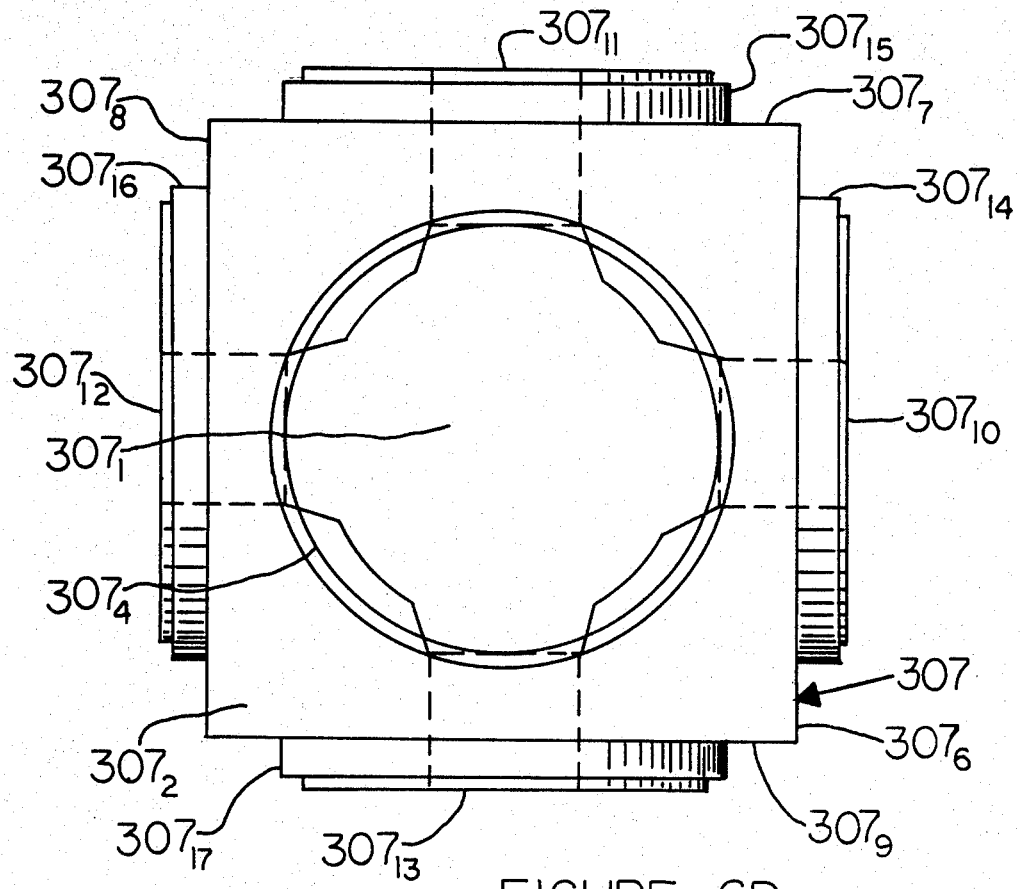
Figure 6:
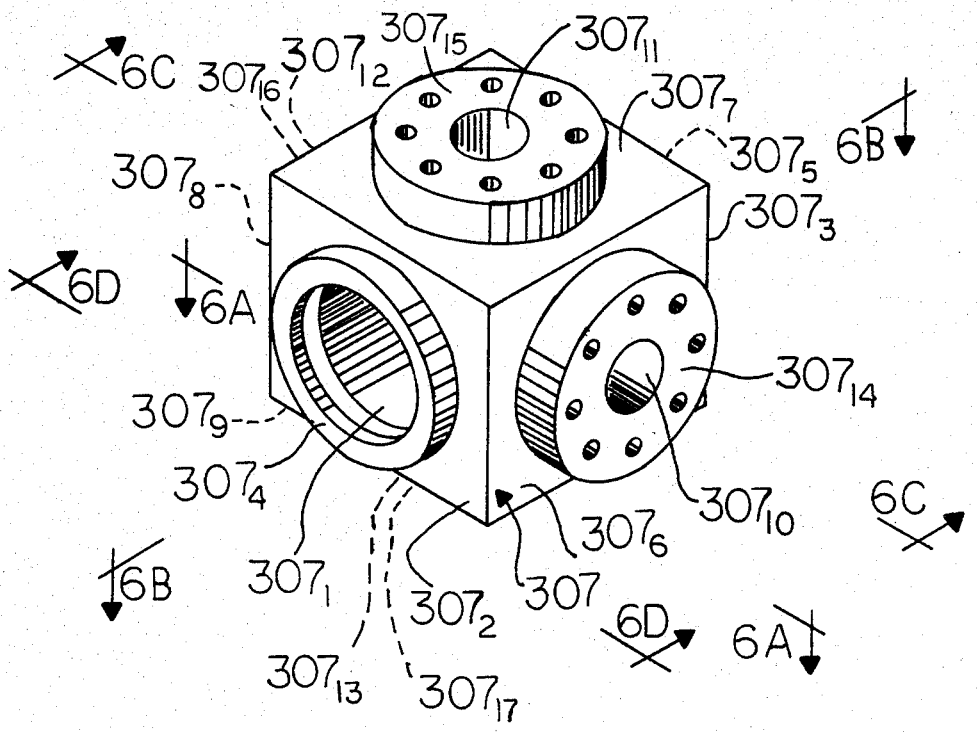
Figure 6C:
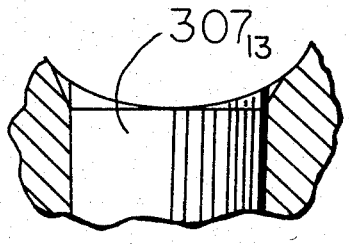
Figure 6A:
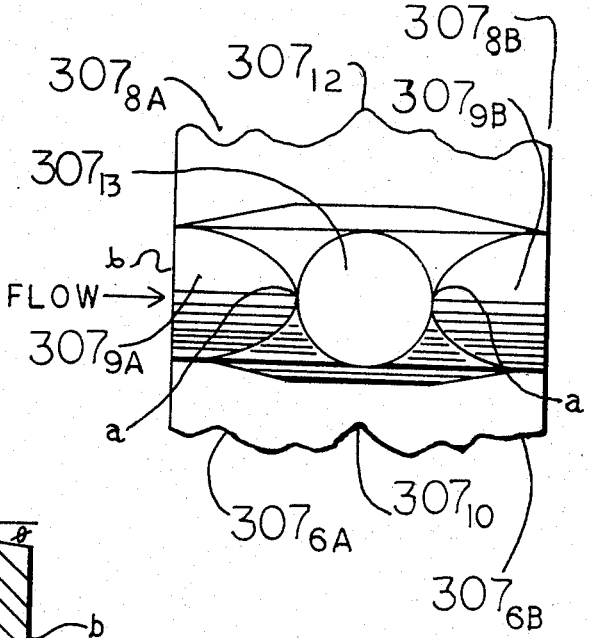
Figure 6B:
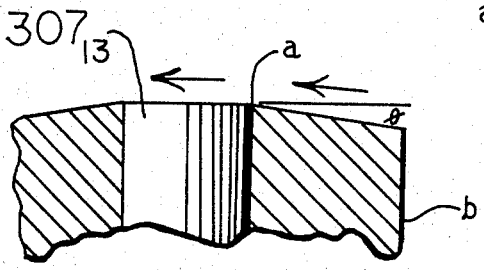

FIG. 6 depicts in perspective a constant area flow condition and instrument flush process mounting block. FIG. 6A depicts a partial plan section view of said block across section 6A—6A. FIG. 6B depicts a partial vertical section view of said block across section 6B—6B. FIG. 6C depicts a partial lateral section view of said block across section 6C—6C, and FIG. 6D depicts a front end view across section 6D—6D of said block showing tapered adaptor slots for fluid flow profile conditioning.

Figures 7, 7A:
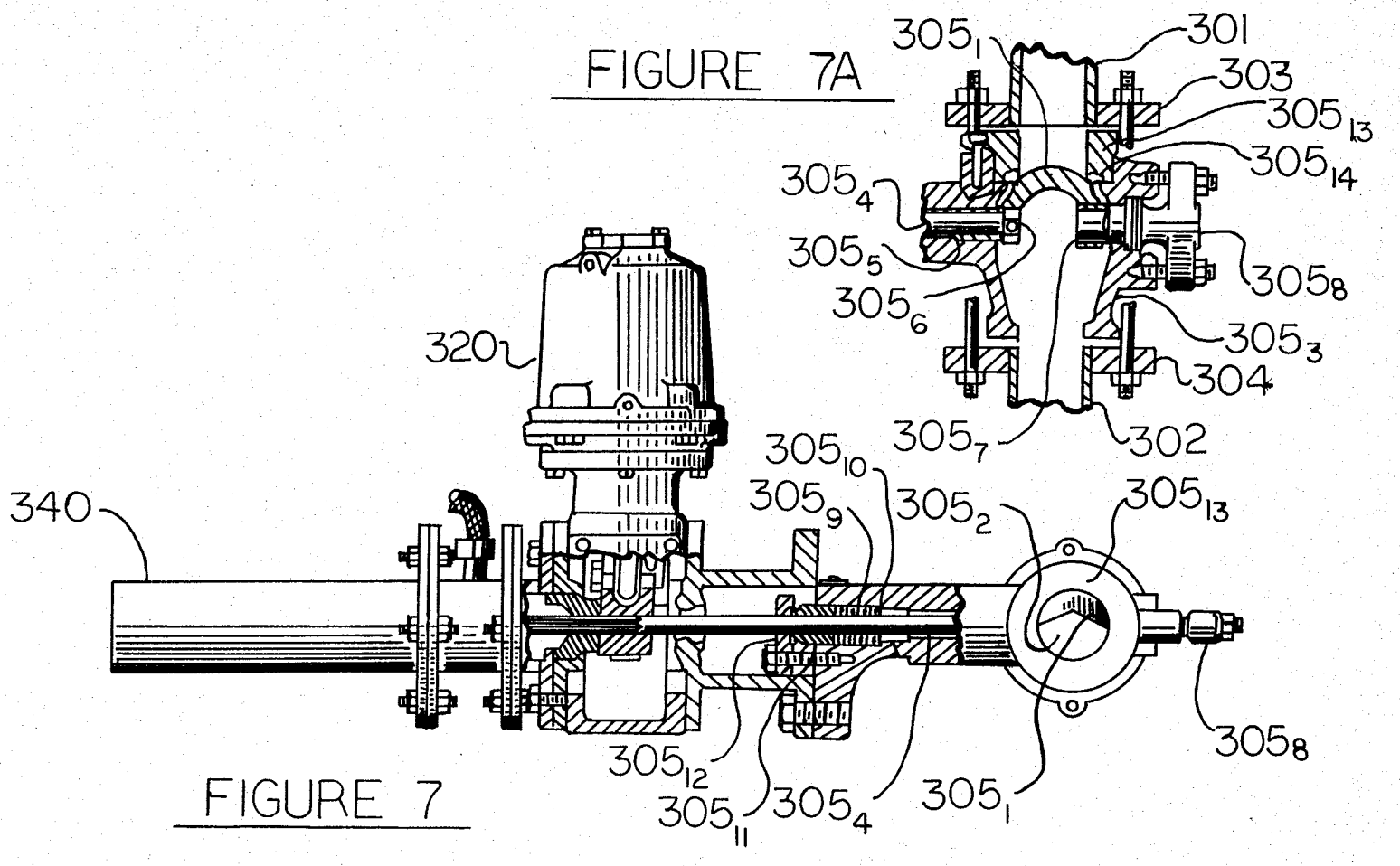

FIG. 7 depicts an end view of a variable orifice with an operator, shown in partial section; and associated optical encoder. FIG. 7A depicts a sectional top plan view of the variable orfice.

Figure 8:
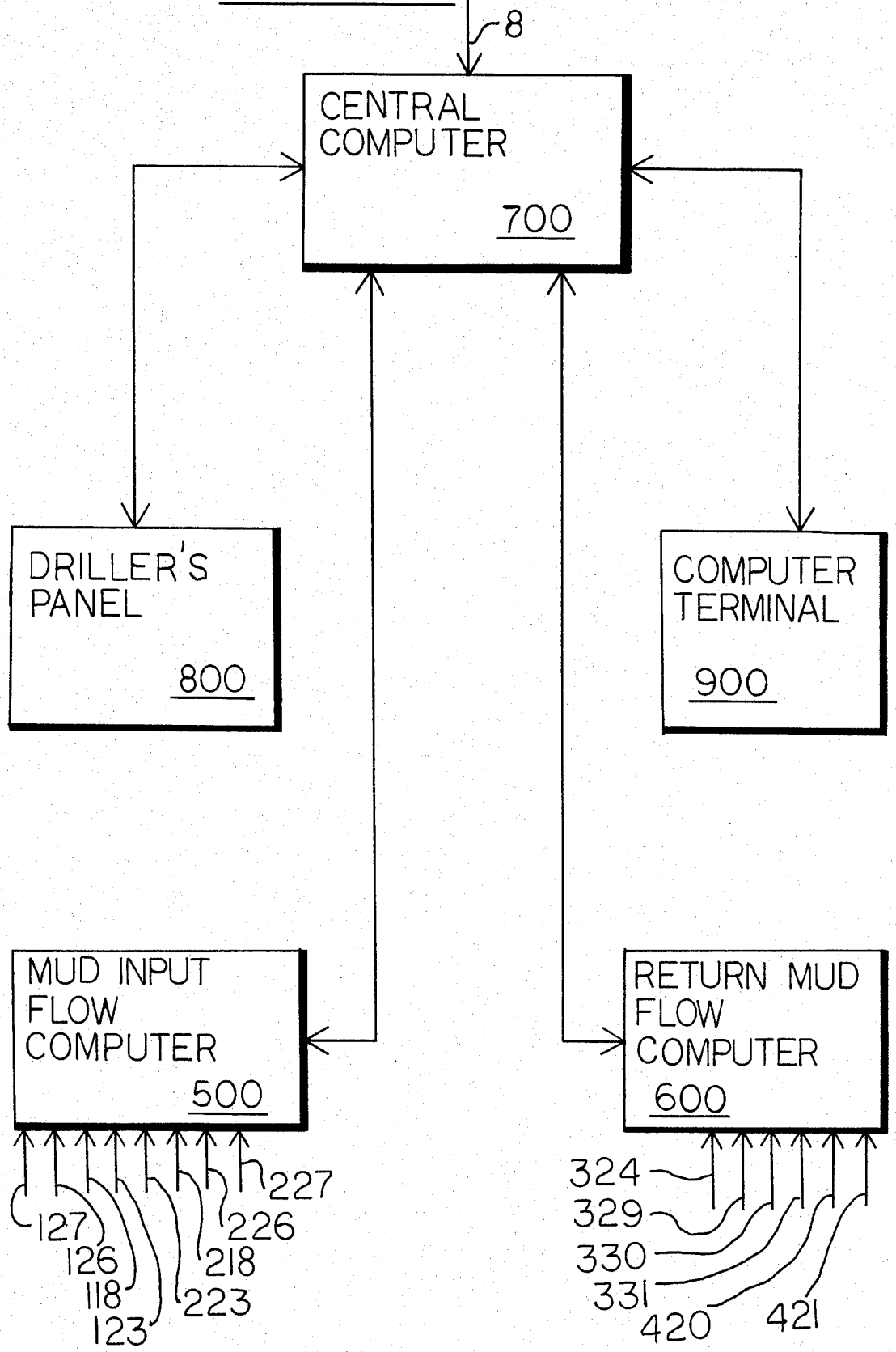

FIG. 8 depicts schematically a preferred system computer block diagram.

Figure 1:
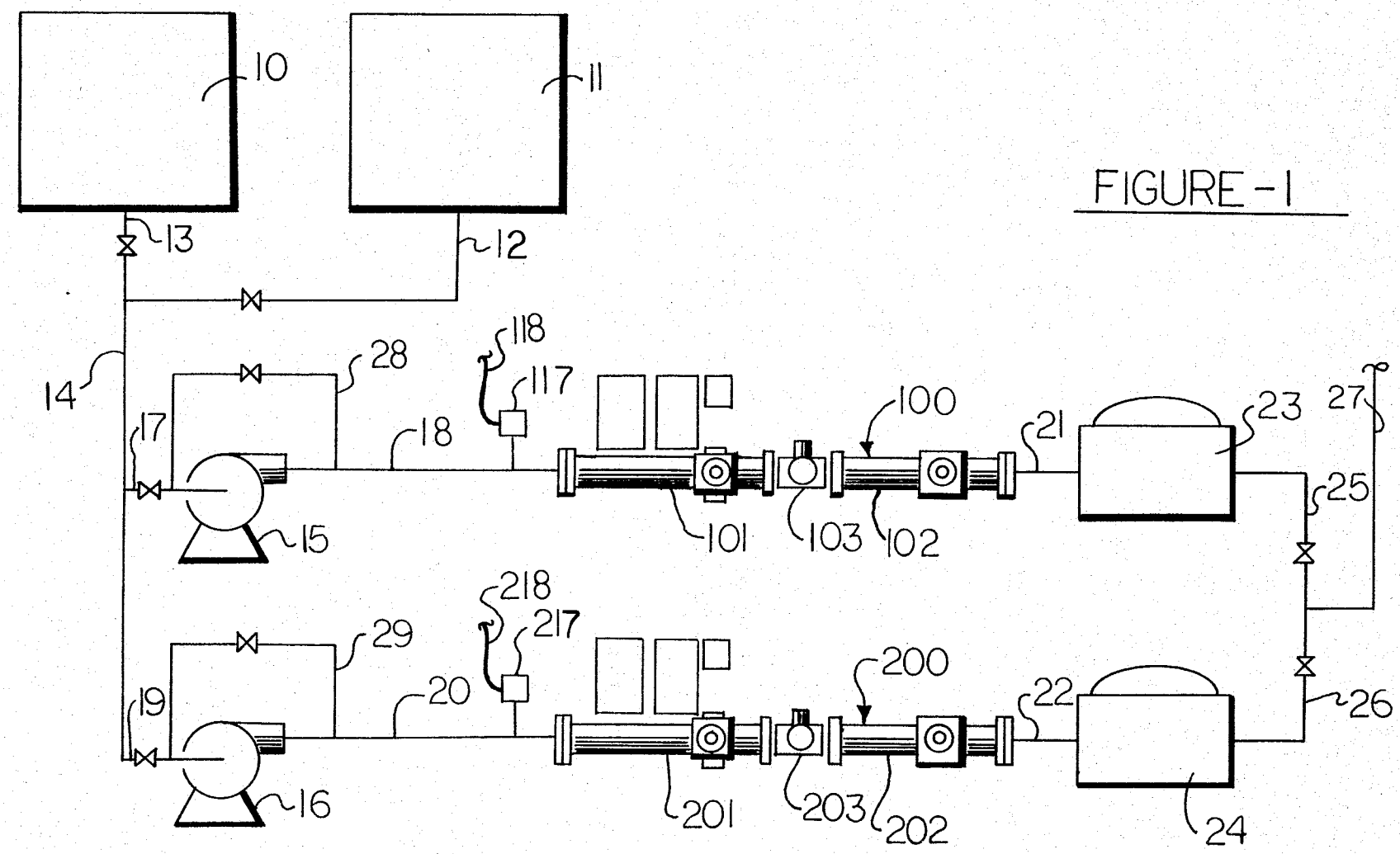
Figure 2:
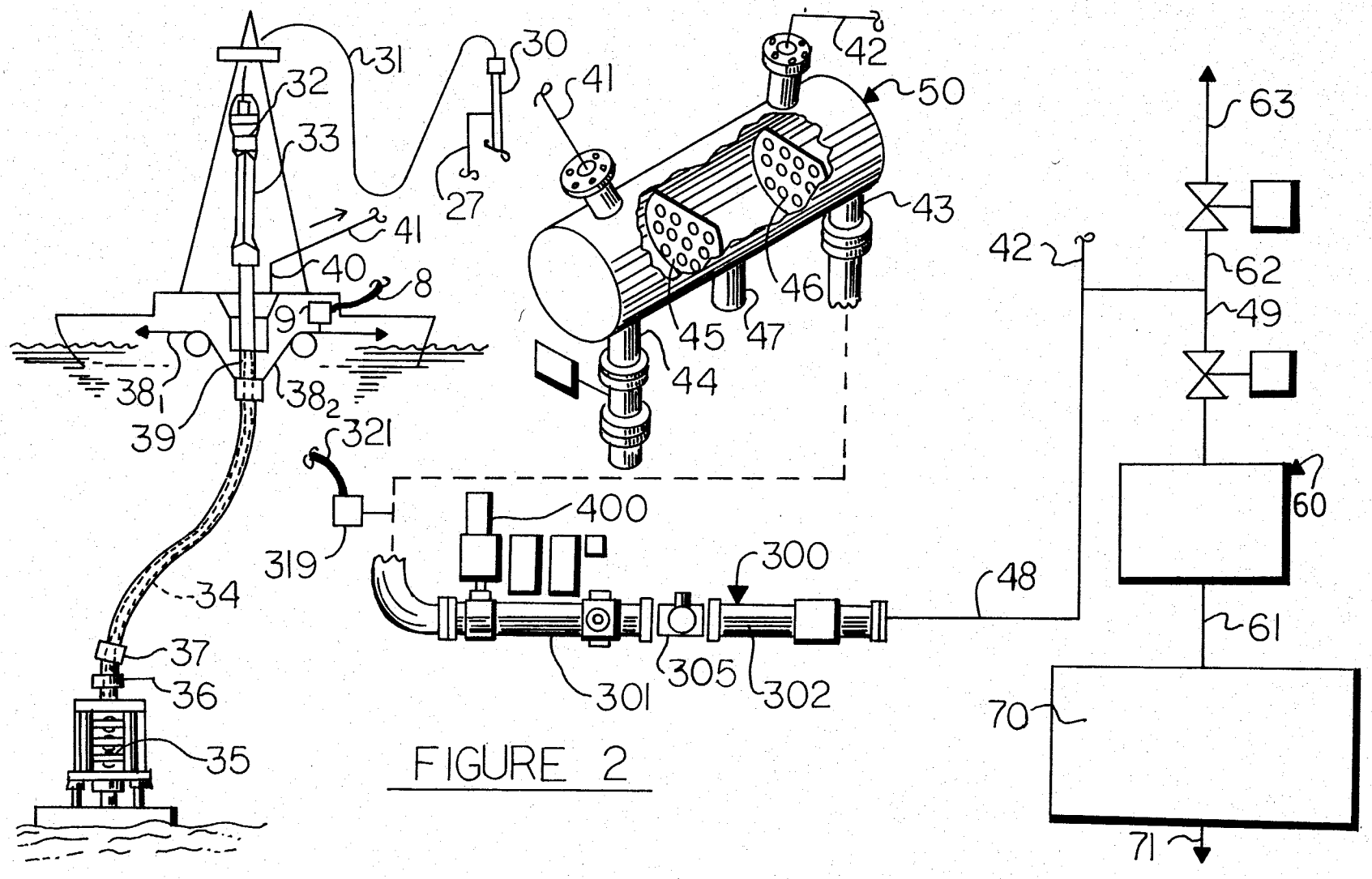

Referring first to FIGS. 1 and 2 there is depicted a schematic flow diagram, or general lay out, of preferred apparatus for measuring various parameters inclusive of the amount of input mud to the well, drill pipe, or drill string, the amount of return mud from the well casing annulus, and rate differences between the input and output flows in real time. The system includes a pair of inlet mud measurement primary devices 100, 200 (FIG. 1) arranged in parallel one with respect to the other into and through which mud is flowed, or pumped, to the drill string for downward passage into the well bore. Within each of mud measurement primary devices 100, 200 the differential pressure across the orifice, orifice position, density and temperature (generally in pounds per square inch, percent of rotation, pounds per gallon and Fahrenheit degrees, respectively) of the mud is read and these measurements input to a mud input flow computer 500 (FIG. 8). The system also includes a return mud primary measurement device 300 (FIG. 2) for the measurement of various parameters of the return mud, inclusive of differential pressure across the orifice, orifice position, density and temperature. The return mud primary measurement device 300 is located downstream of a surge tank, or chamber 50 which is used exclusively in measuring the mud return flow from marine floating installations, i.e. off-shore semi-floating and floating vessels. The return flow measurement portion of the system also includes a gas monitor 400 upstream of the return mud primary measuring device 300, the gas monitor 400 being used to determine the amount of gas entrained in the mud returned from down-hole, it being necessary to compensate for the percent volume of gas within the return mud in the mud flow calculations. The mud differential pressure across the orifice, orifice position, gas volume, density and temperature determinations made by the return mud primary measuring device 300 are included in the input to a mud return flow computer 600 (FIG. 8). Where the system is used in offshore semi-floating and floating drilling operations vessel heave is also measured and input to a central computer 700, into which input is also received from the mud input flow computer 500 and mud return flow computer 600.

On the mud input side, specific reference being made to FIG. 1, one or a series of mud storage tanks 10, 11 are manifolded together such that mud can be flowed via valved lines 12, 13 into a manifold line 14. Mud from manifold line 14 can be introduced or fed via the use of mud charge pumps 15, 16, together or alternately, into inlet mud measurement primary devices 100, 200. Thus, mud from manifold 14 can be withdrawn via valved line 17 and introduced via line 18 into the input mud primary measuring device 100, or mud introduced via valved line 19 into the suction side of charge pump 16 can be fed via line 20 into the input mud primary measuring device 200, or both. Mud is withdrawn from input mud primary meters 100, 200 via lines 21, 22, respectively, by action of mud pumps 23, 24 the mud being pumped via valved lines 25, 26 and line 27 to the drill string of a drilling rig. Suitably, the mud is pumped into the input mud primary measuring devices 100, 200 at a pressure of about 30 pounds per square inch gauge (psig), and across each of which a nominal differential pressure of about 1 (pound per square inch) psi to about 3 psi is maintained. The charge pumps 15, 16 are provided with valved by-pass lines 28, 29 to facilitate pump repair. Drilling fluid measurement may be made without charging pumps 15, 16 if necessary. Temperature measurements can be made via the use of temperature measuring devices 117, 217 located upstream of the input mud measuring primary devices 100, 200. Within each of the input mud measuring primary devices 100, 200 measurements are made of the density and flow rate, the latter being determined from measurements made of the differential pressure on passage of the mud through a variable orifice, and the position of the variable orifice along with compensation factors. Liquid viscosity may be measured by means of a viscosimeter (not shown) or preferably, the appropriate viscosity compensation factors are calculated within the in-flow computer from measured flowing data, stored calibration data, and data concerning the geometry of the orifice. Mud withdrawn from input mud measuring primary devices 100, 200 via the mud pumps 23, 24, respectively is pumped under considerable pressure to a standpipe 30 (FIG. 2), and then into the kelly hose 31, through the kelly hose 31, swivel connection 32 downwardly through the kelly 33 into the drill string 34 to the bottom of the well bore.

On the well output side, continuing the reference to FIG. 2, mud from the well bore exits via the drill bit and ascends from below the earth's surface through BOP stack 35, past connector 36 and ball joint 37 to exit from the well via the casing annulus and bell nipple 40 through line 41. Vessel motion, or heave, can be measured by the amount of linear movement of a tensioner $38_1$, $38_2$ across its respective idler sheave located above the telescopic joint 39 and this measurement input via lead 8 of a linear measuring device 9 to the central computer 700. Alternatively, vessel accelerations can be measured at appropriate locations and transmitted to the central computer 700 for interpretation, and then transmitted to the control panel for vessel heave display.

Mud from the casing annulus is flowed via line 41 into a baffled surge chamber 50 installed upstream of and at a higher elevation than the gas monitor 400, and return mud primary measuring device 300. A portion of the entrained gas from the mud is removed from the surge tank 50 via line 42. Large chunks of mud, rocks, oversized cuttings or similar agglomerates transported from down hole can be removed from the surge tank 50 via valved outlet 44 at the bottom, forward end of the surge tank 50. The mud, which is maintained at a level within the surge tank 50, is flowed through baffles, or perforated weirs 45, 46 and removed from the bottom of the surge tank 50 via the outlet line 43.

The surge chamber 50 contains a liquid, or mud level detector 47, a device with span selected to cover the overall range required. Mud enters the top of the baffled surge chamber 50 via line 41 and gravity flows via line 43 down through the meter tubes 301, 302. A controlled variable hydrostatic head, i.e. a surge chamber level variation, is produced by controlling the variable orifice area of the return mud primary measuring device 300 via the return mud flow computer 600. The level control point is determined as a function of the flow, viscosity, density, percent gas, orifice geometry, and temperature. The control point is established irrespective of level changes due to the motion of the vessel. The level control system assures that changes in the flow through meter tubes 301, 302 is always equal to changes in the flow into the surge chamber 50 due to changes in circulation rates, or due to kicks. By varying the point of level control with respect to orifice geometry, density, and temperature, the differential pressure across the variable orifice of the return mud primary measuring device 300 is controlled to prevent flashing, and consequently cavitation.

Mud from the surge chamber 50, which yet contains entrained gas, is analyzed by a gas monitor 400 for determination of the gas content, the gas content of the mud being applied as a correction factor in the calculations for mud flow. Mud, downstream of the gas monitor or analyzer 400, is passed through the return mud primary measuring device 300 wherein measurements are made of the temperature, density and flow rate, the flow rate being determined from indirect measurements made of the upstream pressure, differential pressures on passage of the mud through the variable orifice of the return mud primary measuring device 300, the position of the orifice and compensation factors. Effluent mud from the return mud primary measuring device 300 is passed via line 48 and valved diverter line 49, into a clay ball tank 60, from which chunks of mud, rocks, oversized cuttings or other agglomerates can be removed. The mud from the clay ball tank 60 is then passed via line 61 to a shale shaker 70, then via line 71 to mud clean up and storage and thence to tanks 10, 11 for recycle. A safety feature provides for the automatic diversion of gas and mud through line 42 to either line 62 or line 49 at the operators discretion.

Figure 3:
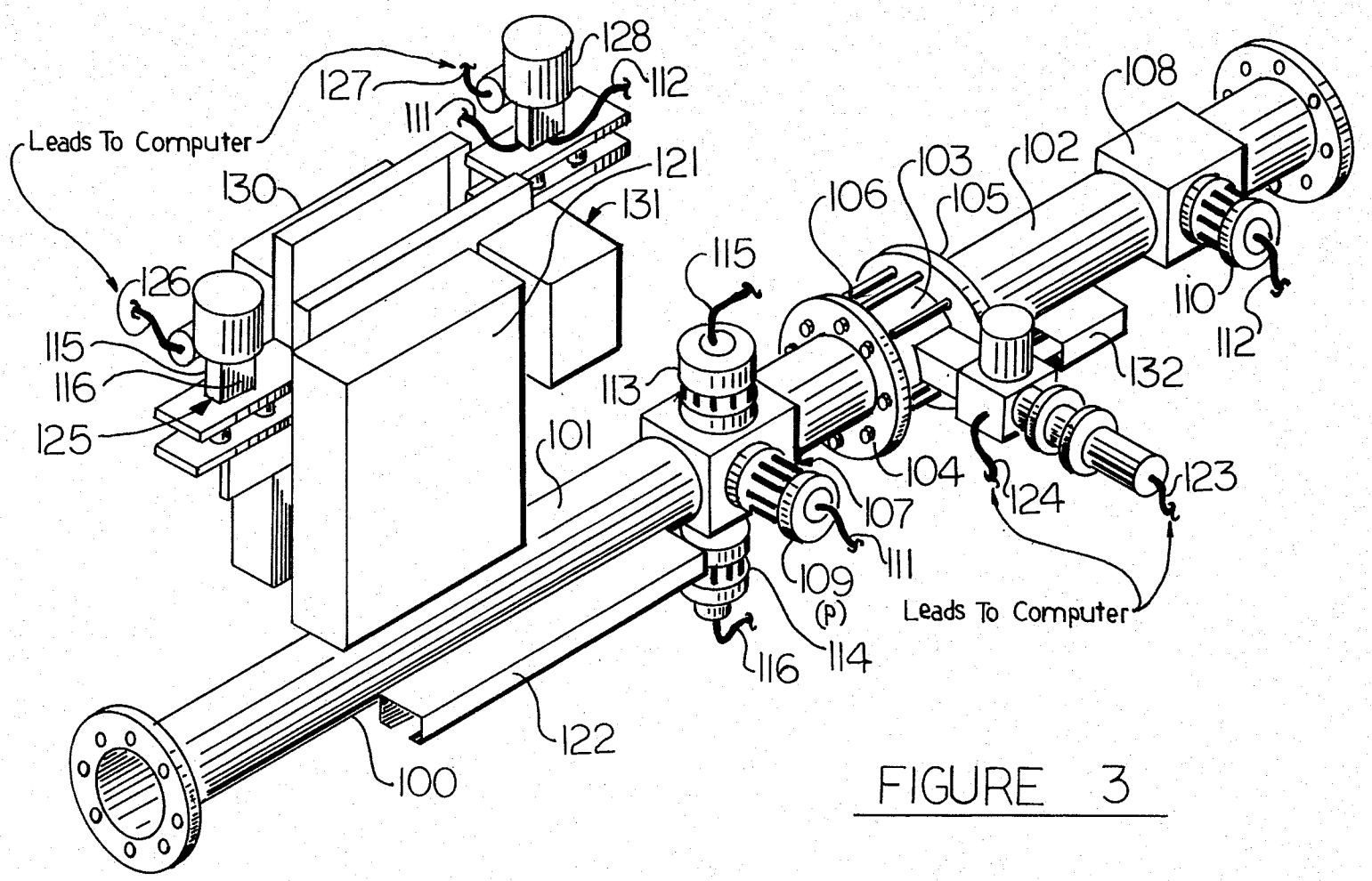
FIG. 3 depicts in perspective an input mud measurement primary device.

Referring again to FIG. 1 generally, and to FIG. 3 specifically, there is detailed the various components of a mud inlet measurement primary device 100; the mud inlet measurement primary device 100 and the inlet measurement primary device 200 being identical in all respects except as hereinafter described, and differ from the return mud measurement primary device 300 only in the additional presence of a gas monitor 400 and an upstream gauge pressure, transmitter in said primary device 300 described hereinafter. The mud inlet primary measurement device 100 is constituted generally of two meter tubes 101, 102 secured together via their flanged ends 104, 105 by means of a plurality of bolts 106 circumferentially arrayed about the variable orifice device 103, the latter of which operates on the differential pressure principle. Each of meter tubes 101 and 102 contain a six-sided block 107, 108, or block of hexahedron design, through two alternate faces of each of which is provided an axial opening concentric with and aligned upon the axial openings of meter tubes 101, 102 through which mud is flowed. The remaining four sides of a six-sided block 107, 108 are fitted with, or can be fitted with primary process sensing devices. Two sensing devices 109, 110 connected to transmitting device 128 via liquid filled lines 111, 112 are employed for measuring differential pressure created by the mud flow through the variable orifice primary 103, the electrical output from the transmitting device 128 being transmitted via electrical lead 127, to the mud inlet computer 500. Two alternately disposed primary sensing devices 113, 114, located atop and at the bottom respectively, of the block 107, connected to transmitting device 125 via liquid filled lines 115 and 116, are employed for measuring the density of the mud using the differential pressure created by the column of liquid between sensing devices 113 and 114, the differential reading between the pressures of the sensing devices 113, 114 being input via lead 126 to the mud input flow computer 500 wherein density is calculated. Temperature measurements are made by primary sensing device 117 (FIG. 1), located in line 18 upstream of measurement primary 100, the temperature reading being input to the mud input flow computer 500 via electrical lead 118. Similarly, temperature measurements can be made by primary sensing device 217 (FIG. 1) located upstream of measurement primary 100, and the temperature measurements input to the mud input flow computer 500 via electrical lead 218. Junction boxes 121, 130 and 131 are provided atop meter tube 101 for use in locating electrical wiring, pneumatic leads, circuit components and the like; and cable trays 122 and 132 for storing cable are located alongside meter tubes 101 and 102.

Figure 4:
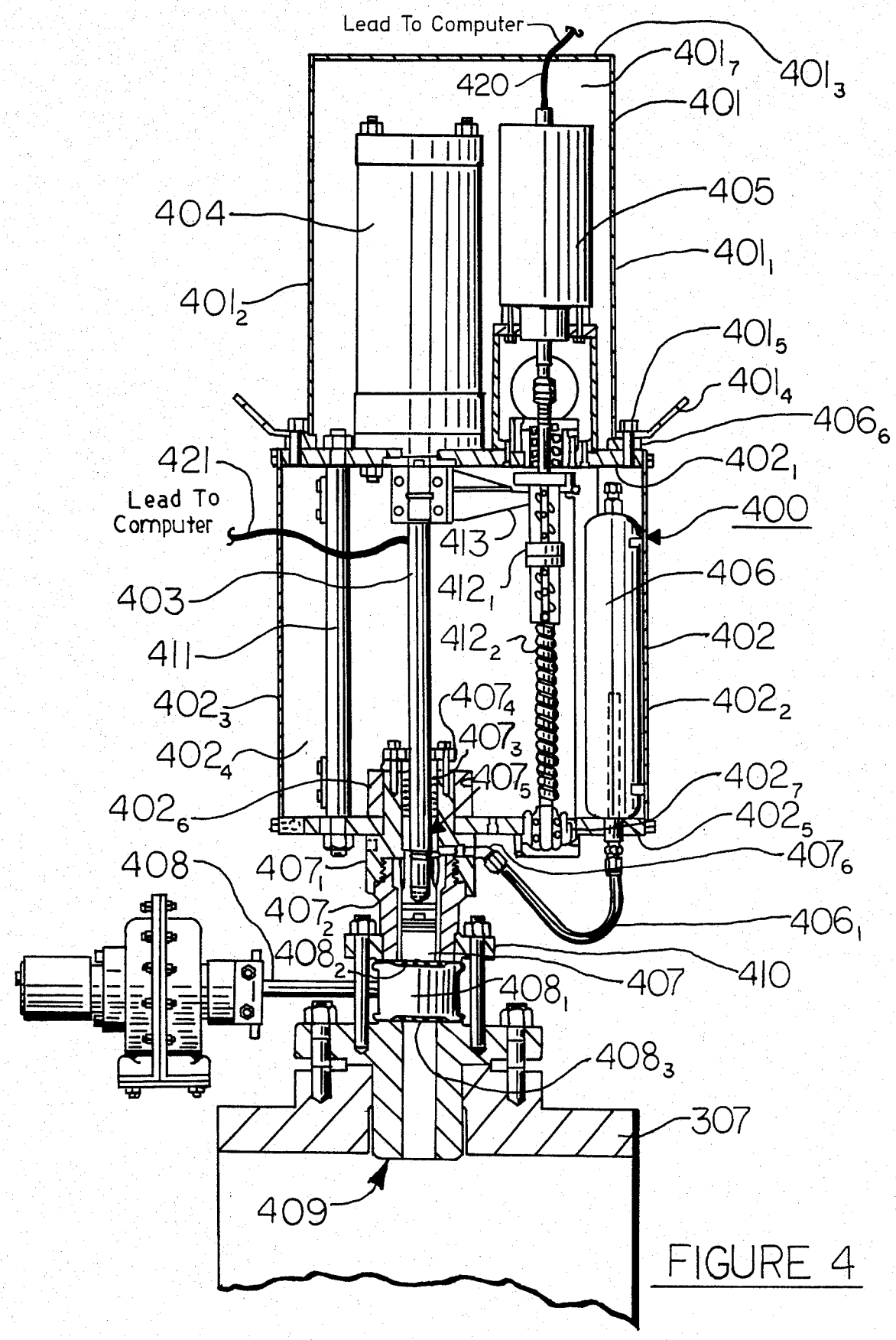
FIG. 4 depicts in section a gas monitor, a device located adjacent to and just downstream of the surge chamber.

The gas monitor 400, and its function, are best described by further reference to FIG. 4. Its function is to measure the percent of free gas, or percent entrained gas, contained in the mud. The amount of entrained gas contained in mud must be compensated for in determining the fluid quantity, and flow rate of the mud returned from down-hole. The gas monitor 400 is a cyclic mud sampling device, or apparatus, controlled by the return mud flow computer 600 with a variable measurement period, suitably a period ranging from about 18 seconds to about 120 seconds. A relatively long cycle is used in the measurement until the percent gas of the return mud exceeds a predetermined value at which time the device is automatically switched, to a faster sampling rate. On return of the gas content of the mud to a lower value the length of the cycle is again extended. The variable sample rate, among other things, is useful in extending the life of the device.

The gas monitor 400 includes generally a housing, or a pair of housings, an upper housing 401 (or cover) and a lower housing 402 within which certain vital components of the gas monitor 400 are contained, and sheltered. Essential components included within the housings are a piston 403 and its pneumatic actuator or operator 404, a precision piston position measurement device, suitably an optical encoder 405 and an oil lubricant supply canister 406. The gas monitor 400 also includes a measurement chamber 407, and an air actuated sample valve 408 located below the housings 401, 402. Mud from the meter tube 301 on retraction of the piston 403 fills the measurement chamber 407, and on the closing of the sample valve 408, an analysis for the percent of gas entrained in the mud is made.

The upper portion of the gas monitor 400, continuing reference to FIG. 4, is provided with an upper housing 401 inclusive of side walls $401_1$, $401_2$, top wall $401_3$, back wall $401_7$, and front wall (not shown in this figure). The upper housing 401 is mounted atop a lower housing 402 having a top wall $402_1$, side walls $402_2$, $402_3$, back wall $402_4$, front wall (not shown in this figure) and a bottom wall $402_5$. The upper housing 401, or cover, is attached via a lower flanged edge $401_4$ to the lower housing 402 via a plurality of bolts $401_5$, gaskets $401_6$ being located between the upper edges of top wall $402_1$ and lower flanged edges $401_4$ of the bottom wall. The housings 401, 402 are further secured one to another, braced and supported via the tubular member(s) 411 through which are bolted above and below. The bottom wall $402_5$ of the lower housing 402 is provided with an inwardly projecting nozzle $402_6$ which fits over, mates with and engages an upwardly projecting nozzle portion $407_1$ of the measurement chamber 407. The upper wall $402_1$ between the upper housing 401 and lower housing 402 is provided with openings within a first of which is mounted the assembly comprised of a pneumatic actuator 404 and piston 403, the piston 403 being projected downwardly into a sealed inlet leading into the measurement chamber 407. The wall $402_1$ also carries and provides major support for a piston position optical encoder 405, the lower end of which is retained within a well $402_7$ located in the bottom wall $402_5$ of the lower housing 402. An oil lubrication assembly 406, for use in maintaining the cleanliness of the measurement chamber 407, is supported upon the side wall $402_2$, and bottom wall $402_5$ of the lower housing 402.

The measurement chamber 407 is a cylindrical shaped opening within a tubular member $407_2$, the latter being threadably engaged with a second tubular member $407_1$ an upper smaller outside diameter section of which is projected upwardly into the inwardly projected nozzle opening $402_6$ located within the bottom wall of housing 402. The axial openings through the two tubular members $407_1$, $407_2$ are concentrically aligned, and the upper portion of the tubular member $407_1$ is provided with a tubular packing or gland $407_3$ through the axial opening in which the lower end of the plunger 403 is projected, and sealed. Pressure upon the packing $407_3$ is maintained for effective sealing via means of the packing follower $407_4$ which is bolted to the upper face of the tubular member $407_1$; guide bushings $407_4$, $407_5$ acting as a guide, and as support for the plunger 403. The forward end of the plunger 403, provided with top and bottom cylindrical shaped pressure energized seals $403_1$ of external diameter substantially equal to the internal diameter of the measurement chamber 407, contains a primary pressure sensing element $403_2$ which indicates the pressure within the measurement chamber 407. A lateral opening, or port located in the lower end of the tubular member $407_1$ is provided with an oil fitting $407_6$, connected via a flexible tube $406_1$ to the oil filled cylinder 406 for lubrication of the sample measurement chamber 407 when it is purged of mud, as on the full downward stroke of the plunger 403 when the plunger 403 has passed through an opening through the ball valve portion $408_1$ of the ball valve 408.

Figure 4A:
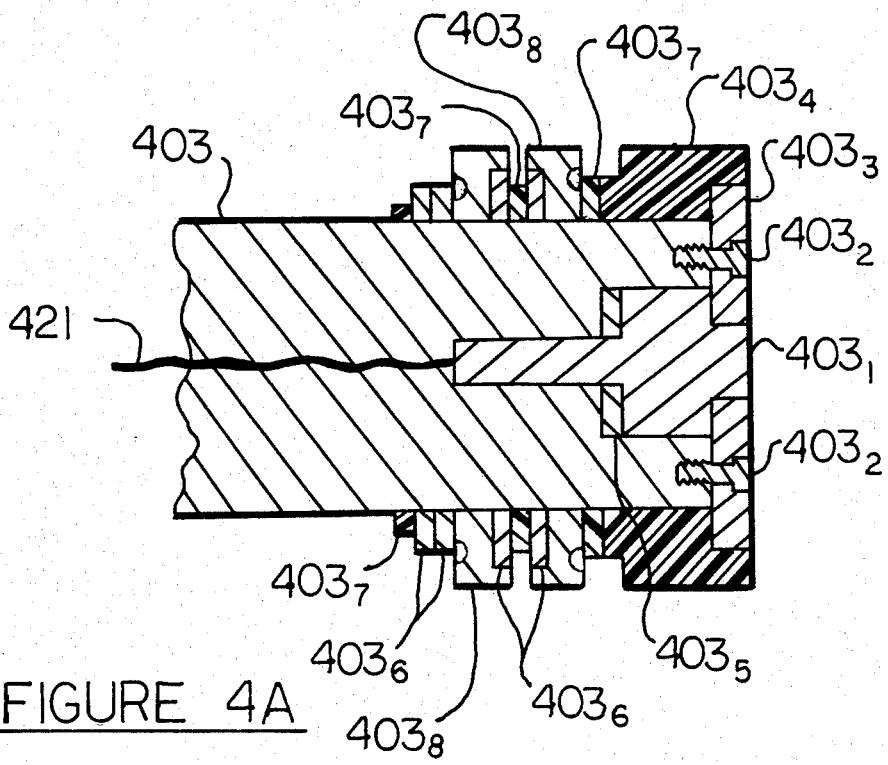
FIG. 4A depicts in section an enlarged view of the head of the piston portion of said gas monitor.

Whereas pressure sensing means may be located anywhere within chamber 407, a preferred location is within the head of piston 403 itself. Referring to FIG. 4A there is thus shown a preferred structure for mounting the pressure sensing means upon the lower or forward end, or head of the piston body 403. The lower or forward terminal end of the piston body 403 is thus recessed and therein is placed, and retained a pressure sensor $403_1$. The upper side of the pressure sensor $403_1$ is rested against a gasket $403_5$ through the open center of which a shank portion thereof is extended, and the lower end thereof is retained in place via the presence of an open centered piston nose piece $403_3$ held in place upon a polyurethane wiper ring $403_4$ via nose piece cap screws $403_2$. The wiper ring $403_4$ is in turn held upon the lower end of the piston 403 via front, center and rear spiral lock rings $403_7$ between which are sandwiched forward and rear pressure energized seals $403_8$ and stiffiner rings $403_6$. The computer lead 421 extends from the upper, or rearward end of the pressure sensor $403_1$ through the piston 403 to transmit pressure readings sensed by the forward exposed face of the pressure sensor $403_1$.

A third tubular member constituting an integral part of flange 409 having a large external diameter extended lower end, it will be noted, is bolted securely to mounting block fitting 307; the large lower end of said tubular member 409 being fitted snugly within a central opening through block 307. The axial opening through tubular member 409 is concentric with and of substantially the same internal diameter as the axial opening through tubular members $407_1$, $407_2$. The axial openings of tubular members $407_2$, 409 form, when the ball valve portion $408_1$ of ball valve 408 is open, a path through which mud can flow to fill measurement chamber 407 when the plunger 403 is retracted. Or, on the other hand, when the ball valve portion $408_1$ of ball valve 408 is open it forms a conduit from which the mud can be pushed out of the measurement chamber 407 and back into the meter tube 301 on the downward stroke of the plunger 403.

The measurement chamber 407, it will be observed, is opened and closed via the air actuated ball valve 408. The ball portion $408_1$ of the valve is located between a pair of pressure energized seals $408_2$, $408_3$ and provided with a single cylindrical opening therethrough such that actuation and rotation of the ball through a first 90° turn will close the valve, and reverse rotation of the ball through a second 90° turn will open the valve. When the valve 408 is open, and piston 403 is retracted mud contained within the meter tube 301, since it is under pressure, will flow upwardly into and fill the measurement chamber 407 up to and flush with the face of the piston 403, the lower end of which in its fully retracted position defines the upper end of the measurement chamber 407. A pressure sensor $403_1$, or primary device for sensing pressure, it will be observed, is located within the chamber 407, suitably in the face of the piston 403. The pressure reading taken by pressure sensor $403_2$ serves to measure the amount of force exerted on the mud taken into the sample chamber 407.

The function of the optical encoder 405 is to measure the exact position of the piston 403 within the measurement chamber 407 throughout a cycle of operation. The gas monitor 400 operates by measuring within the measurement chamber 407 the volume of compressable material within the mud, which is a multiphase slurry of gases, liquids and solids. Inasmuch as only the entrained gas is significantly compressable, the piston 403 is applied with a downward force to exert a compressive force on the mud, the optical encoder 405 reading the piston displacement, the pressure sensor $403_1$ reading the force applied. The curve generated is a function of chamber pressure vs. piston position. The slope of the first part of the curve is monitored to determine gas volume. The second part of the curve is steeper, the slope of the second part of the curve being representative of the compression of the liquid and solids phases of the sample. The slope of the first part of the curve is readily recognizable from the slope of the second part of the curve. A correction factor, derived by monitoring piston displacement at constant chamber pressure above critical pressure is subtracted from the total piston displacement to indicate the volume of gas within the mud to compensate for leakage around the annulus of piston 403 or across the seals $408_2$, $408_3$ of the ball valve portion $408_1$ of ball valve 408.

The following describes an operating cycle, to wit: In its fully downwardly extended position the piston 403 extends through the opening in the ball valve portion $408_1$ of ball valve 408, and the forward face of the plunger is flush with the exit port of nozzle 409 to the opening into meter tube 301. The piston 403 is retracted through the ball valve portion $408_1$ of ball valve 408, mud from the meter tube 301 passing upwardly to fill the tubular opening of tubular members 409, $407_2$ up to the face of plunger 403. The valve 408 is then closed, thus sealing chamber 407 to trap the specimen of mud located above the valve opening between said closed valve and the face of plunger 403. A measurement of sample volume in terms of piston displacement is then begun with the downward application of force on the plunger 403, with concurrent downward movement of the piston 403. Piston displacement is monitored by the optical encoder 405, or other precise measurement device suitably e.g. to 1 part per 0.0005 inch linear displacement. Piston 403 is coupled to encoder 405 via zero hysteresis double ball nut $412_1$ and lead screw $412_2$. The extension of the piston 403 in such compression stroke raises the pressure of the sample, or specimen of mud in measurement chamber 407 up to, and then above the critical pressure. All of the gases and vapors are essentially converted to an incompressable phase where the rate of change in sample pressure vis-a-vis piston position increases sharply.

During the sensing portion of the measurement cycle, the chamber pressure is monitored and stored for use in calculations to compensate for any sample valve leakage or any leakage around the annulus of the plunger.

When critical pressure is reached, the output of the optical encoder 405 (sample chamber delta volume) represents the percent of combined gases and vapors present in the sample after correction for leakage, if any.

Next the pressure is released by retraction of piston 403, the sample valve is opened and piston 403 is extended to its initial position returning the sample to the flow stream of meter tube 301 and wiping the measurement chamber 407 and sample valve bore clean.

Oil from the oil lubricating cylinder 406 is drawn via hose $406_1$ and oil fitting $407_6$ within the inlet into the measurement chamber 407 following the path of the piston 403, this cleaning and lubricating the measurement chamber and sample valve bore.

Figure 5:
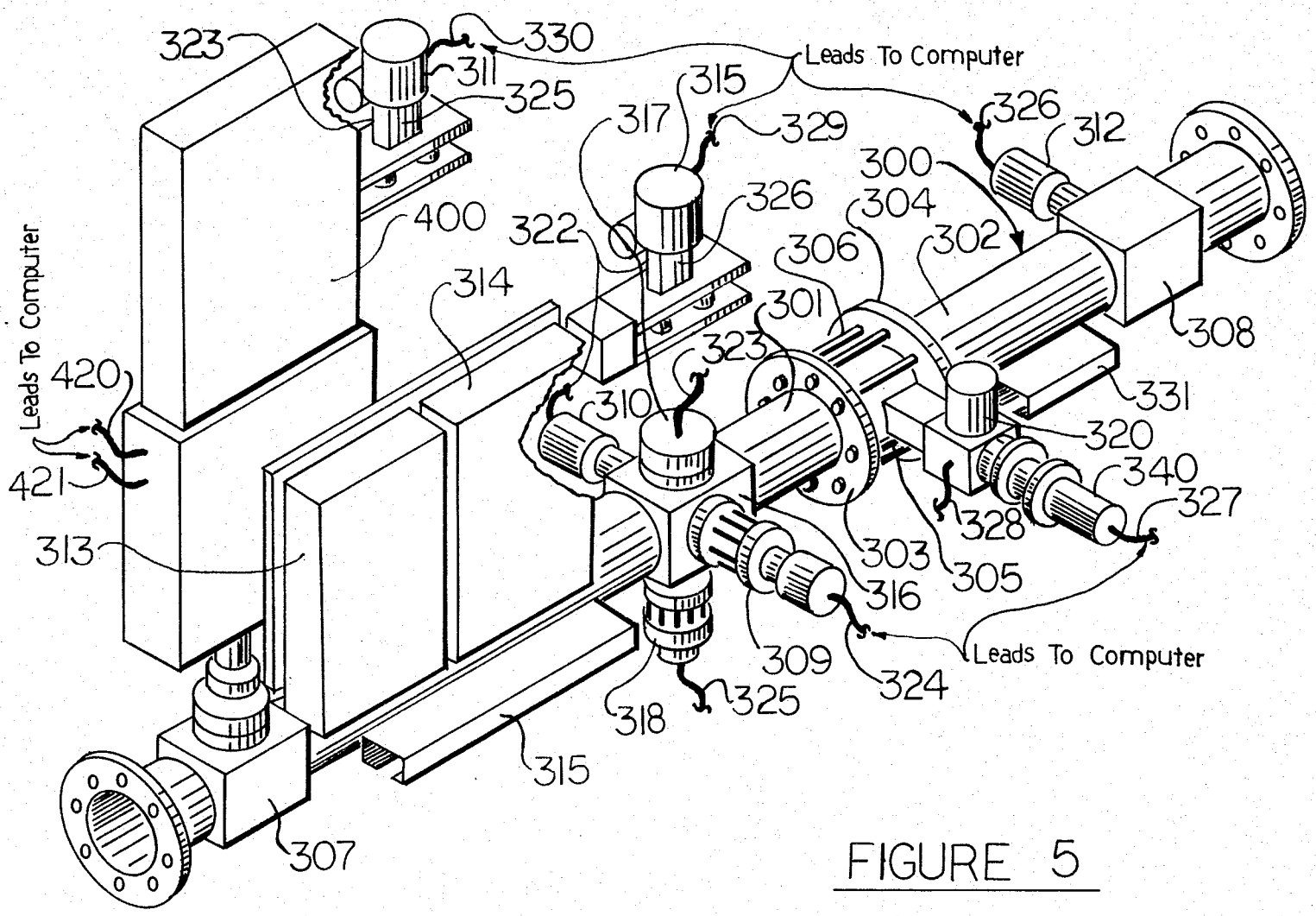
FIG. 5 depicts in perspective a return mud measurement primary device and associated gas monitor.

Referring again to FIG. 2, generally, and to FIGS. 5, 7 specifically, there is shown a mud return primary measuring device 300. Like mud inlet primary measuring devices 100, 200, the mud return measurement primary device 300 is constituted of meter tubes 301, 302, having flanged ends 303, 304, between which is located a variable orifice primary 305, the meter tubes and variable orifice primary being secured together via a plurality of bolts 306. Within each of the meter tubes 301, 302, like e.g. the meter tubes 101, 102, of mud inlet primary measuring device 100, there is provided hexahedron shaped blocks 307, 308, 316. A pair of alternately disposed faces of each of blocks 307, 308, 316 are provided with an axial opening which is concentric with and corresponds with the axial openings of the meter tubes 301, 302 through which mud is flowed. Within the upwardly oriented face of block 307 there is located an opening, or inlet port, over which is fitted the gas monitor 400 (which is described in detail with reference to FIG. 4). The remaining four faces of block 316 are fitted with primary sensing devices, a primary sensing device 309 for sensing pressure, primary sensing devices 317, 318 connected via liquid filled lines 323, 325 to transmitting device 311 for sensing density, and a primary sensing device 310 connected via liquid filled line 322 to transmitting device 315. An outward face of block 308 also contains a primary sensing device 312 connected via liquid filled line 326 to transmitting device 315. Primary sensing devices 310, 312 (via transmitting device 315) are employed to measure the differential pressure created by the mud flow through the variable orifice primary 305. Temperature measurements are made by primary sensing device 319, and signal transmitted to the computer 600 via the lead 321, located in line 43 (FIG. 2) upstream of measurement primary 300. Liquid viscosity may be measured by means of a viscosimeter (not shown) or preferably, the appropriate viscosity compensation factors are calculated within the return flow computer 600 from measured flowing data, stored calibration data, and stored data concerning the geometry of the orifice. Electrical outputs from devices 309, 311, 315, 319 are input to the return mud flow computer 600 for measurement of respective parameters. The primary mud return flow meter 300 is also provided with J-boxes 313, 314, 322 within which are stored pneumatic and electrical leads circuit components and the like; and below the J-boxes 313, 314, 322 there are located cable trays 315, 331.

The variable orifice primary, as suggested, is a feature of both the input mud measurement primary devices 100, 200 and the return mud measurement primary device 300. Since these features, i.e. variable orifice primaries 103, 203, with their primary pressure sensing devices located upstream and downstream, respectively, of the variable orifices, are identical in both the input mud measurement primary devices 100 200 and the return mud measurement primary device 300 a specific, and complete description will be given of the variable orifice primary 305 of the return mud measurement primary device 300. The variable orifice primary is constituted principally of a variable orifice primary 305, a pneumatic, electric or hydraulic operator or orifice positioner 320, and an optical encoder 340 or other suitable high resolution motion measurement device. The variable orifice primary 305 includes an orifice body $305_3$ within which is mounted a self wiping, double trunnion, spline mounted rotatable quartered ball segment, or ball $305_1$ having therein a machined characterized orifice $305_2$. FIG. 7 depicts a preferred triangular or notch characterized orifice; however, any number of orifice bodies, moveable elements and geometric characterizations are useful. The ball $305_1$ is mounted in the straight section of the orifice body $305_3$, the ball $305_1$ being rotated to open and close the orifice via use of a pneumatically, electrically or hydraulically actuated drive shaft $305_4$ capable of positioning the ball $305_1$ within a wide range of positions ranging from closed to wide open. Specifically, the characterized ball $305_1$ is mounted within the orifice body $305_3$ on the terminal end of a drive shaft $305_4$ via connection through a main shaft bushing $305_5$ to which it is secured via a tapered pin $305_6$, and it is rotatably secured on the opposite side of the orifice body $305_3$ via connection through a guide post bushing $305_7$ with the guide post retainer $305_8$, bolted upon the outer side of the orifice body $305_3$. The ball $305_1$ is turned to open and close the opening to the flow of mud from meter tube 301 into and through the seal protector ring $305_{13}$, contact between the seal protector ring $305_{13}$ and forward face of ball $305_1$ being prevented due to the seal $305_{14}$. The opposite end of the drive shaft $305_4$ is projected through the open center of a cylindrical shaped packing $305_9$ held in place by the packing box ring $305_{10}$, packing follower $305_{11}$ and packing flange $305_{12}$ which is bolted in place on the opposite end of the orifice body $305_3$. To the orifice body $305_3$ is bolted an assembly constituted of an actuator 320, which is spline mounted to the drive shaft $305_4$ for actuation and rotation of the latter to rotate the characterized ball $305_1$, and a high resolution optical encoder 340. The actuator 320 can be hydraulic, electric, pneumatic, or combination thereof; and, it can be a direct digital stepper motor with an encoder incorporated into the motor shaft.

The actuator 320 is capable of positioning the ball $305_1$ within about 0.02 degrees of rotation such that the capability of the device is in excess of 300 positions. The high resolution optical encoder 340 is spline mounted to the drive shaft $305_4$, secured by tapered shaft pin $305_6$, the function of the optical encoder 340 being to read the precise position of the variable orifice, or characterized ball $305_1$ and input same to the return mud flow computer 600. Suitably, the encoder resolution is one part in 2500 over 90 degrees of orifice rotation.

The differential pressure across the orifice, or characterized ball $305_1$ is measured by two pressure sensors 309, 312 one mounted within the meter tube 301 upstream of the variable orifice, or characterized ball $305_1$, and the other downstream thereof. The process diaphragm of each is mounted flush with the inside wall of the meter tubes 301, 302, respectively. The two pressure sensors 309, 312 may be in pressure communication with two individual transducers or transmitters or the two may be in pressure communication with a single differential pressure transducer or transmitter. As mud passes through the variable orifice, or characterized ball $305_1$, a differential pressure is created which is proportional to the rate of flow, the fluid density and a coefficient related to the geometry of the orifice, or characterized opening $305_2$ in characterized ball $305_1$. The orifice area, or size of the opening provided by the orifice $305_2$, is controlled by the mud input flow computer 500 to maintain a selected average differential pressure across the orifice primary. The control point is determined in part by the discharge characteristics of the primary and in part by the necessity of preventing flashing cavitation; flashing being a function of mud temperature, vapor pressure, orifice geometry, and differential pressure across the orifice. By establishing "worse case" conditions flashing, and hence cavitation, is prevented as a function of temperature and differential for a known geometry.

The characterized opening in the ball $305_2$ is always located at the very bottom of the valve body $305_3$, and in-line with the very bottom of the meter tubes 301, 302 with the minimum area of the characterized opening or apex of the triangle shown in FIG. 7 faced upwardly. Rotation of the ball $305_1$ to open the orifice $305_2$ always results in the uncovering of the minimum area of the open area first; the orifice $305_2$ opening to expose additional and wider increments of the lower portion of the open area as the orifice is opened wider. Conversely, rotation of the ball $305_1$ to close the orifice always results in covering the wider portion of the open area first; the orifice $305_2$ closing to block off additional wider increments of the open area. A feature of the characterized opening is that the mud flow is always directed along the very bottom of the meter tubes 301, 302. The accelerated fluid stream is directed along the axis of the meter tube to minimize impingment on the meter tube walls and to remove sedimentary material up and downstream of the variable orifice. Abrasion and wear which is a common problem in most slurry handling devices are minimized. The characterized opening in the ball $305_1$, preferably of triangular shape as shown in FIG. 7, establishes a specific and repeatable flow response to orifice position as well as providing a predictable relationship between the discharge characteristics of the orifice and the rotation of the ball $305_1$.

The hexahedronal, or hexagonal shaped blocks 107, 108 and 207, 208, respectively, of mud measurement primary devices 100, 200 and hexagonal shaped blocks 308, 316 of the return mud primary measurement device 300 are constant area flow tubes, or flow tubes of cross sectional area at every point identical to that of the cross sectional area of meter tube to which each are adjoined, and through the outer faces of each are provided openings within which primary sensing elements are projected, or which can be projected for the measurement of temperature, density, pressure or the like. The primary function of the hexahedronal shaped blocks is to condition the process fluid stream such that a specific fluid profile is maintained through the block from entrance across flush sensors to exit without imparting turbulence or axial acceleration to the process fluid. The flow sections of these hexahedronal shaped blocks through which the fluid is passed are also of special contour to straighten, smooth out or suppress turbulent flow of fluid through a respective meter tube, and block, to provide more laminar flow. Since the hexagonal blocks are of similar design, reference is made to FIG. 6 which depicts in greater detail the construction of hexagonal block 307 of the return mud measurement primary measurement device 300.

Referring to FIG. 6, 6A, 6B, 6C, 6D, the hexahedronal block 307 is provided with an axial opening $307_1$ extending through the block from a front face $307_2$ to a rearward face $307_3$, a lip, ridge, or rim $307_4$, $307_5$ around each opening providing a surface for extension into and mating engagement with the face of straight sections of meter tube 301 to which the block is adjoined such that mud can flow through axial openings of substantially identical cross-sectional diameter from one tubular section of the meter tube and tnrough the opening $307_1$ through the hexahedronal block 307 to the next adjoining tubular section of the meter tube. The remaining four outer faces $307_6$, $307_7$, $307_8$, $307_9$ of the hexahedronal block are provided with openings $307_{10}$, $307_{11}$, $307_{12}$, $307_{13}$ each also of which is provided with a surrounding rim $307_{14}$, $307_{15}$, $307_{16}$, $307_{17}$, or mount for the support of a primary sensing element. The process isolation portion of a primary sensing element is fitted into an opening, the flat diaphragm $307_{13}$ or front portion thereof extending essentially flush with the internal face of the wall which forms opening $307_1$ through the hexahedronal block 307, a base portion of the primary sensing element being provided with a mounting ring which mates with a surrounding rim, to which it is bolted via openings therein which are arrayed in the same pattern and match the circumferentially arrayed openings within a rim $307_{14}$, $307_{15}$, $307_{16}$, $307_{17}$ for engagement therewith.

The flat forward ends, or diaphragm portions of the primary sensing devices are snugly fitted into the openings $307_{10}$, $307_{11}$, $307_{12}$, $307_{13}$ squared, and mounted to extend to a point essentially equal with the wall surface, forming the opening $307_1$. To provide a transition of the fluid shape from the cylindrical geometry of the meter tube to the flat geometry of the process sensor, areas in front of and rearward of the openings $307_{10}$, $307_{11}$, $307_{12}$, $307_{13}$ at the locations of entry into the block 307 are scored, grooved or cut out, and material removed to form, in plan view, indentations of hemi-eliptical shape. The inside diameter of the block is reduced at the rate required to replace the material removed to form the hemi-eliptical geometry. Hence the constant cross-sectional area is maintained.

The indentations $307_{6A}$, $307_{6B}$, $307_{7A}$, $307_{7B}$, $308_A$, $308_B$, $307_{9A}$, $307_{9B}$ (only the latter $307_{9A}$, $307_{9B}$ of which is shown in FIG. 6A) are cut in the front and rear of each of the openings $307_{10}$, $307_{11}$, $307_{12}$, $307_{13}$, the narrower side "a" of each indentation touching a side wall opening. For example, the narrower edges "a" of indentations $307_{9A}$, $307_{9B}$ each touch alternate sides of the peripheral edges of opening $307_{13}$. The alternate wider sides of each of the indentations $307_{6A}$, $307_{6B}$, $307_{7A}$, $307_{7B}$, $307_{8A}$, $307_{8B}$, $307_{9A}$, $307_{9B}$ respectively, are located at an edge, or face $307_2$, $307_3$, $307_6$, $307_7$, $307_8$, $307_9$ respectively, of the block 307. The rearward, wide side of an indentation on the upstream side of the block 307, as demonstrated in FIG. 6B, is cut deeper than the narrower side of the indentation or, in other words, sloped upwardly so that the particles contained in the fluid are thrust slightly upwardly to prevent direct impingement of the particles upon the face of a diaphragm of a primary sensing device fitted into a side wall opening. For example, the upstream edge of "b" of the indentation $307_{9A}$ and the downstream edge "a" of the indentation $307_{9A}$ form a slope of angle $\phi$ ranging from about 0° to about 10°, depending on the internal diameter.

Referring to FIG. 6C, it will also be observed that the upper edges of the indentations $307_{6A}$, $307_{6B}$, $307_{7A}$, $307_{7B}$, $307_{8A}$, $307_{8B}$, $307_{9A}$, $307_{9B}$ (only the latter $307_{9A}$, $307_{9B}$ of which are shown in FIG. 6C) are sloped outwardly as contrasted with the bottom edges, the slope forming an angle of inclination ranging from about 15° to about 45°, preferably about 30°. Mud flowing through the indentations is gradually thrust upwardly and over a diaphragm, and on the downstream side of a diaphragm the mud is turned gradually downwardly into a downwardly sloping indentation on the downstream side of said diaphragm. The land areas between the indentations $307_{6A}$, $307_{6B}$, $307_{7A}$, $307_{7B}$, $307_{8A}$, $307_{8B}$, $307_{9A}$, $307_{9B}$ form lateral guideways to smooth out and direct the mud flow into a more laminar, or streamlined flow pattern.

An axial opening, or bore through a hexahedronal block, e.g. block 307, is thus doubly tapered from an entry side to an exit side. The diameter within the grooved area is slightly larger at the fluid entry side, and narrows on approaching the center of the bore at the location of the openings $307_{10}$, $307_{11}$, $307_{12}$, $307_{13}$ within which sensing devices can be mounted. The diameter within the grooved area again expands, and becomes slightly larger on approaching the fluid exit side of the bore. This feature provides, in its total geometric configuration, the constant cross sectional area flow path through a block.

A schematic diagram of the mud flow computer system, usually contained within a single cabinet (not shown), is described by reference to FIG. 8. The system includes one or more computers, suitably a mud input flow computer 500, a return mud flow computer 600, a central computer 700, a driller's display and keyboard panel 800, and computer terminal 900. Each of the three computers 500, 600, 700 are complete with processor, memory, input/output and power supplies.

The following measurements are transmitted to the mud input flow computer 500, to wit:

The mud flowing into the mud input side of measurement primary devices 100, 200 at blocks 107, 207 near the suction side of each mud pump 23, 24 and downstream thereof at blocks 108, 208 is measured for fluid temperature, orifice position, fluid density, and differential pressure across the primary. These inputs are transmitted to the mud input flow computer 500 via leads 118, 123, 126, 127, and leads 218, 223, 226, 227. Various other inputs (not shown) can also be transmitted to the mud input flow computer 500, e.g. the open/closed status of inlet and outlet valves, as well as the monitoring of flush valves and drain valves, junction box purge status and the like.

The following measurements are transmitted to the mud return flow computer 600, to wit:

The mud flowing out of the well casing is measured for inlet pressure in the primary, differential pressure across the primary, fluid density, fluid temperature, the position of the piston in the gas monitor 400, the gas monitor sample chamber pressure, the position of the orifice 305 and the liquid level in the surge chamber 50.

These inputs are transmitted to the mud return flow computer via electrical leads 324, 329, 330, 331, 420, 421. Various other inputs can also be made to the mud return flow computer 600, e.g. the open/closed status of inlet and outlet block valves 307, 308 flush and drain valves and the gas monitor 400 sample valve are monitored along with the junction box purge integrity status.

The following measurements are transmitted to the central computer 700, to wit:

Vessel heave can be measured in terms of tensioner motion and input, e.g. from a measuring device 9 via a lead 8 to central computer 700. Combined vessel effective motion can also be measured in terms of acceleration at either or both the in-flow primary and the return flow primary. Atmospheric pressure can also be measured, as well as the run status of the mud pumps, the charge pumps, the riser circulating pump, if any, and the fill pump, if any, can be monitored along with the purge integrity status of the driller's panel cabinet, and various junction boxes.

The mud in-flow computer 500 calculates the fluid density, the fluid viscosity, and compensated flow of the mud into the drill pipe annulus; controls the position of the variable orifice; controls the flush, drain and calibration sequences and establishes the appropriate alarms and/or shutdowns for sequence, purge or computer abnormalities. The mud in-flow computer 500 is in continuous data communication with the central computer 700.

The mud return flow computer 600 calculates the fluid density (two conditions), the fluid viscosity, the compensated flow of the mud from the casing annulus; calculates the percent of gas and vapor contained in the fluid; controls the position of the variable orifice; controls flush, drain, and calibration sequences; and establishes the appropriate alarms and/or shutdowns for sequence, purge or computer abnormalities. The return flow computer 600 is in continuous data communication with the central computer 700.

The central computer 700 calculates the compensations required by vessel motion and atmospheric conditions; calculates the mud being introduced into the hole by the fill pumps; monitors the trip tank level, volume and liquid density; calculates the flow of mud into the riser from the riser circulating pump; calculates the delta flow, delta density and total mud gained or lost over a period of time and monitors the run/stop status of both mud pumps, the fill pump and the riser circulating pump. The central computer 700 monitors for excessive gain or loss in flow rate, total mud and liquid density. The computer establishes alarms and/or shutdowns for mud condition abnormalities as well as purge and computer abnormalities. The central computer 700 is in continuous two way communication with the driller's panel 800.

The driller's panel 800 receives and displays data from the central computer 700, receives commands from the operator and transmits these commands via the computer terminal 900 to the central computer 700 and controls audible alarms, and filter drain valves. The fill pump and the riser circulating pump can be started and stopped by pushbutton switches on the driller's panel.

It is apparent that various modifications and changes can be made without departing the spirit and scope of the invention. For example, changes can be made in the number of components, size, shape, relative dimensions and various construction materials can be used.

Having described the invention what is claimed is:

1. Apparatus for the measurement or control, or both, of the flow of a fluid over a wide range of flow conditions and compositions, which comprises:

a measurement primary device through which said fluid is passed, the primary measuring device being provided with a variable orifice primary, means for measuring density, and rate of flow of the fluid via differential pressure means located on opposite sides of said variable orifice, these measurements being input to a computer which calculates the density, viscosity and the compensated flow of the fluid, the computer controlling the variable orifice of the measurement primary in relation to input signals received from the measurement primary device.

2. Apparatus for the measurement of the flow of drilling mud over a wide range of flow conditions and mud compositions, which comprises:

a measurement primary device through which said drilling mud is passed, the mud primary measuring device being provided with a variable orifice primary, means for measuring density, and rate of flow of the mud via differential pressure means located on opposite sides of said variable orifice, these measurements being input to a computer which calculates the density, viscosity and the compensated flow of the mud, the computer controlling the variable orifice of the mud measurement primary in relation to input signals received from the mud measurement primary device.

3. The Apparatus of claim 2 wherein the drilling mud measured by the mud measurement primary device is the mud input to a well bore.

4. The Apparatus of claim 2 wherein the drilling mud measured by the mud measurement primary device is the mud output from a well bore.

5. The Apparatus of claim 2 wherein the drilling mud measured by the mud measurement primary device is the mud input to a well bore, and two of the mud measurement primary devices are employed in parallel.

6. The Apparatus of claim 2 wherein one or more of the mud measurement primary devices are employed to measure the input mud to a well bore, and one or more of the mud measurement primary devices are employed to measure the output mud from a well bore.

7. The Apparatus of claim 6 wherein the measurements made by the mud measurement primary device as relates to the mud input to the well bore is input to a mud input flow computer, the measurements made by the mud measurement primary device as relates to the mud output from the well bore is input to a return mud flow computer, and both the inputs from the mud input flow computer and return mud flow computer are in continuous data communication with a central computer, the central computer calculating gains and losses in mud flow rate, total mud and mud density, and carries on a continuous two way communication with a control panel from which commands are received.

8. The Apparatus of claim 7 wherein the combination includes a gas monitor located just upstream of the return mud flow measurement primary, output mud from the well bore is passed through the gas monitor wherein the percent gas contained in the mud is determined and output to the return mud flow computer, and correction made by the return mud flow computer of the mud density, and flow of return mud from the well bore.

9. The Apparatus of claim 7 wherein the combination includes a surge chamber and a gas monitor in series just upstream of the return mud flow measurement primary, output mud from the well bore is passed through the surge chamber wherein a specific mud level is maintained by controlling the rate of flow of the mud through the return mud flow measurement primary, output mud from the surge chamber is passed through the gas monitor wherein the percent gas contained in the mud is determined and output to the central computer, and corrections made by the return mud flow computer of the mud density, and flow of return mud from the well bore.

10. The Apparatus of claim 7 wherein mud from the well bore is returned via the riser of a marine drilling installation, a heave monitor is placed on the cable connections of the riser to the vessel to measure the vertical movements of the vessel, and the heave measurements are transmitted to the central computer for interpretation, and use.

11. In combination, Apparatus for the measurement or control, or both, of the flow of fluid over a wide range of flow conditions and compositions, which comprises:

a meter tube through which a fluid can be passed, a member containing a characterized orifice located within a straight section of said meter tube, the member being movable to provide a large range of open positions which permit the passage of fluid from an upstream portion of the meter tube to a downstream portion of the meter tube, relative to the location of the orifice, or closed to shut off the flow of fluid through the meter tube, differential pressure sensors located upstream and downstream of the orificed member for determination of the flow rate of the fluid, and means for reading the position of the orificed member, the output of which with the pressure measurements are transmitted to a computer for regulation of the differential pressure across the orifice via input from the computer.

12. In combination, Apparatus for the measurement of the flow of drilling mud over a wide range of flow conditions and mud compositions, which comprises:

a meter tube through which a drilling mud can be passed, a mounted ball containing an orifice located within a straight section of said meter tube, the ball being rotatable to provide a large range of open positions which permit the passage of drilling mud from an upstream portion of the meter tube to a downstream portion of the meter tube, relative to the location of the orifice, or closed to shut off the flow of drilling mud through the meter tube, differential pressure sensors located upstream and downstream of the orificed ball for determination of the flow rate of the mud, and means for reading the position of the orificed ball, the output of which with the pressure measurements are transmitted to a computer for regulation of the differential pressure across the orifice via input from the computer.

13. The Apparatus of claim 12 wherein the mounted ball is provided with a characterized orifice, the smallest portion of the characterized opening of which is faced upwardly, makes its initial appearance and moves upwardly as the orifice is opened from the closed position to increase mud flow through the meter tube.

14. The Apparatus of claim 13 wherein the device turndown capability is in excess of 300:1.

15. The Apparatus of claim 12 wherein the means for reading the position of the orificed member is an optical encoder, and the optical encoder is controlled by the computer to maintain a differential pressure across the orifice.

16. The Apparatus of claim 12 wherein the meter tube also contains differential pressure sensors, a low pressure sensor located on the top of the meter tube and high pressure sensor located on the bottom of the meter tube, for measuring the density of the fluid passing through the meter tube.

* * * * *